United States Patent [19]

Lahr et al.

[11] Patent Number: 4,680,159

[45] Date of Patent: Jul. 14, 1987

[54] STORAGE CONTAINER ASSEMBLY FOR ACCOMMODATING INDIVIDUAL FUEL RODS OF IRRADIATED NUCLEAR REACTOR FUEL ELEMENTS

[75] Inventors: Helfrid Lahr, Karlsdorf; Bernd Pontani, Alzenau, both of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 767,182

[22] Filed: Aug. 19, 1985

[30] Foreign Application Priority Data

Aug. 17, 1984 [DE] Fed. Rep. of Germany ..... 3430243

[51] Int. Cl.[4] ..... G21F 5/00

[52] U.S. Cl. ..... 376/272; 250/507.1

[58] Field of Search ..... 376/272; 250/506.1, 250/507.1; 206/408, 521; 220/348, 85 H, 246; 252/633

[56] References Cited

U.S. PATENT DOCUMENTS

| | | | |
|---|---|---|---|
| 2,984,399 | 5/1961 | Gaulke | 206/521 |
| 3,020,037 | 2/1962 | Bache et al. | 206/521 |
| 3,111,586 | 11/1963 | Rogers | 250/507.1 |
| 3,179,243 | 4/1965 | Ashcroft | 376/272 |
| 3,845,315 | 10/1974 | Blum | 376/272 |
| 3,967,748 | 7/1976 | Albert | 220/348 |
| 4,002,238 | 1/1977 | Camaron et al. | 206/408 |
| 4,399,366 | 8/1983 | Bucholz | 376/272 |
| 4,414,475 | 11/1983 | Kratz et al. | 376/272 |
| 4,446,063 | 5/1984 | Critchley et al. | 250/507.1 |
| 4,447,729 | 5/1984 | Doroszlai et al. | 250/507.1 |
| 4,457,888 | 7/1984 | Vickrey, Jr. | 376/272 |
| 4,474,727 | 10/1984 | Kmonk et al. | 376/272 |
| 4,488,048 | 12/1984 | Bienek et al. | 376/272 |
| 4,535,250 | 8/1985 | Fields | 250/507.1 |

FOREIGN PATENT DOCUMENTS

| | | | |
|---|---|---|---|
| 0036982 | 10/1981 | European Pat. Off. | 376/272 |
| 3222822 | 12/1983 | Fed. Rep. of Germany | 376/272 |
| 0150811 | 9/1981 | German Democratic Rep. | 250/506.1 |
| 0182392 | 10/1984 | Japan | 376/272 |

*Primary Examiner*—Deborah L. Kyle
*Assistant Examiner*—Daniel Wasil
*Attorney, Agent, or Firm*—Walter Ottesen

[57] ABSTRACT

A storage container is disclosed for accommodating fuel rods of disassembled irradiated nuclear reactor fuel elements. The storage container includes a circular storage space into which a cage receiving the canned fuel rods is inserted. The individual fuel-rod cans are arranged in the insert cage in the form of a circle in order to achieve a good removal of heat. Hold-down springs bear on the end faces of the cans. The radial extension of the fuel-rod cans towards the longitudinal center of the container is limited to accommodate an empty square central shaft in the middle of the insert cage.

8 Claims, 6 Drawing Figures

STORAGE CONTAINER ASSEMBLY FOR ACCOMMODATING INDIVIDUAL FUEL RODS OF IRRADIATED NUCLEAR REACTOR FUEL ELEMENTS

FIELD OF THE INVENTION

The invention relates to a storage container for receiving fuel rods of irradiated nuclear reactor fuel elements. The storage container includes a storage chamber having a circular cross-section for accommodating an insert cage for holding cans filled with fuel rods.

BACKGROUND OF THE INVENTION

For the transportation and storage of irradiated nuclear reactor fuel elements, it is customary to utilize shielded transport and storage containers made of spheroidal cast iron or steel. The inner chamber of the containers can have a round or square cross-section. Containers with a circular inner chamber have the advantage of being easier to manufacture and of optimally utilizing the storage space. The irradiated fuel elements are received in these storage containers in special insert cages.

In addition to the accommodation of complete fuel elements, it has already been proposed to disassemble the fuel elements and to load the individual fuel rods of these fuel elements closely packed into a storage container. Considerable space savings can be achieved thereby. European Pat. No. 0005623 discloses that the storage container is thus capable of holding a larger amount of fuel elements.

According to a state-of-the-art disclosure made in German published patent application No. DE-OS 3,222,822, the fuel rods removed from the fuel elements are closely packed into cans the geometry of which corresponds approximately to one fuel element. The filled cans are then placed into the receiving shaft-like compartments of the insert cage, these compartments being actually configured to hold the fuel elements.

An important technical problem of the storage of individual fuel rods packed as closely as possible in a storage container is the temperaure control of this storage unit. As a result of the decay heat of the radioactive fuel, the temperature within the storage unit may increase inadmissibly. Dissipating the heat from the interior of the fuel rod package involves problems. Consequently, this heat dissipation problem may be the reason for limited packing densities or extended previous decay times of the fuel elements until they can be loaded into the storage container.

SUMMARY OF THE INVENTION

It is therefore an object of the invention to configure a container of the type initially described such that a good heat dissipation from the storage unit is accomplished and that the fuel rods are not impermissibly impaired by heat.

This object is achieved by the storage container of the invention in that: the individual cans are arranged in circular form in the insert cage; the cross-section of the cans is a circular segment; hold-down springs bear on the upper end surfaces of the cans; and, the radial extension of the can segments towards the center is limited so that an empty square shaft is formed in the middle of the insert cage.

Providing the individual fuel-rod cans with a circular-segmental cross-section adapts them well to the round cross-section of the storage space. The curved rear surfaces of the fuel-rod cans rest snugly against the circular inner wall of the container, thereby providing for a good heat transfer between the cans and the storage container. The hold-down springs urge respective ones of the fuel-rod cans in an axially parallel direction against the bottom of the storage container so that the good heat transfer is ensured there also. The empty square shaft formed in the middle of the storage space may be used to accommodate the scrap, that is, spacers and the like which result from separating out individual fuel rods. This structural material of the disassembled fuel elements has a substantially lower heat output than the fuel rods. In addition, it is not affected by heat and is capable of tolerating heat increases unprotected. By contrast, the irradiated fuel rods are not permitted to exceed the temperature limits prescribed by the authorizing governmental agencies because of the risk of leakage. Fissile gases or other radioactive material would then escape.

According to another feature of the invention, double-walled partition units define a hollow space between two adjacent fuel-rod cans. Sectioning the circular storage space in this manner permits fuel-rod cans of identical configuration to be used. Advantageously, one fuel-rod can will accommodate the fuel rods of one fuel element. In addition, the hollow spaces in the partition segments afford the possibility of loading neutron-absorbing or heat-conductive materials. A feature of this embodiment of the invention is that the fuel-rod cans can be made to all have the same configuration.

In another advantageous embodiment of the invention, inclined guides coact with inclined engagement surfaces in the insert cage, and lower guide surfaces eliminate a clearance which may be present between the curved rear surfaces of the fuel-rod cans and the circular inner wall of the storage container.

The invention provides a storage container for accommodating individual fuel rods, which permits the storage of fuel rods having a higher after-heat output. Therefore, after removal of the fuel elements from the spent fuel storage pool and their disassembly into individual fuel rods, the fuel rods may be directly loaded into the container provided for terminal storage. Further interim storage for heat dissipation is not necessary.

BRIEF DESCRIPTION OF THE DRAWING

The invention will now be described in more detail with reference to the drawing wherein.

DESCRIPTION OF THE PREFERRED EMBODIMENTS OF THE INVENTION

Figure 1:
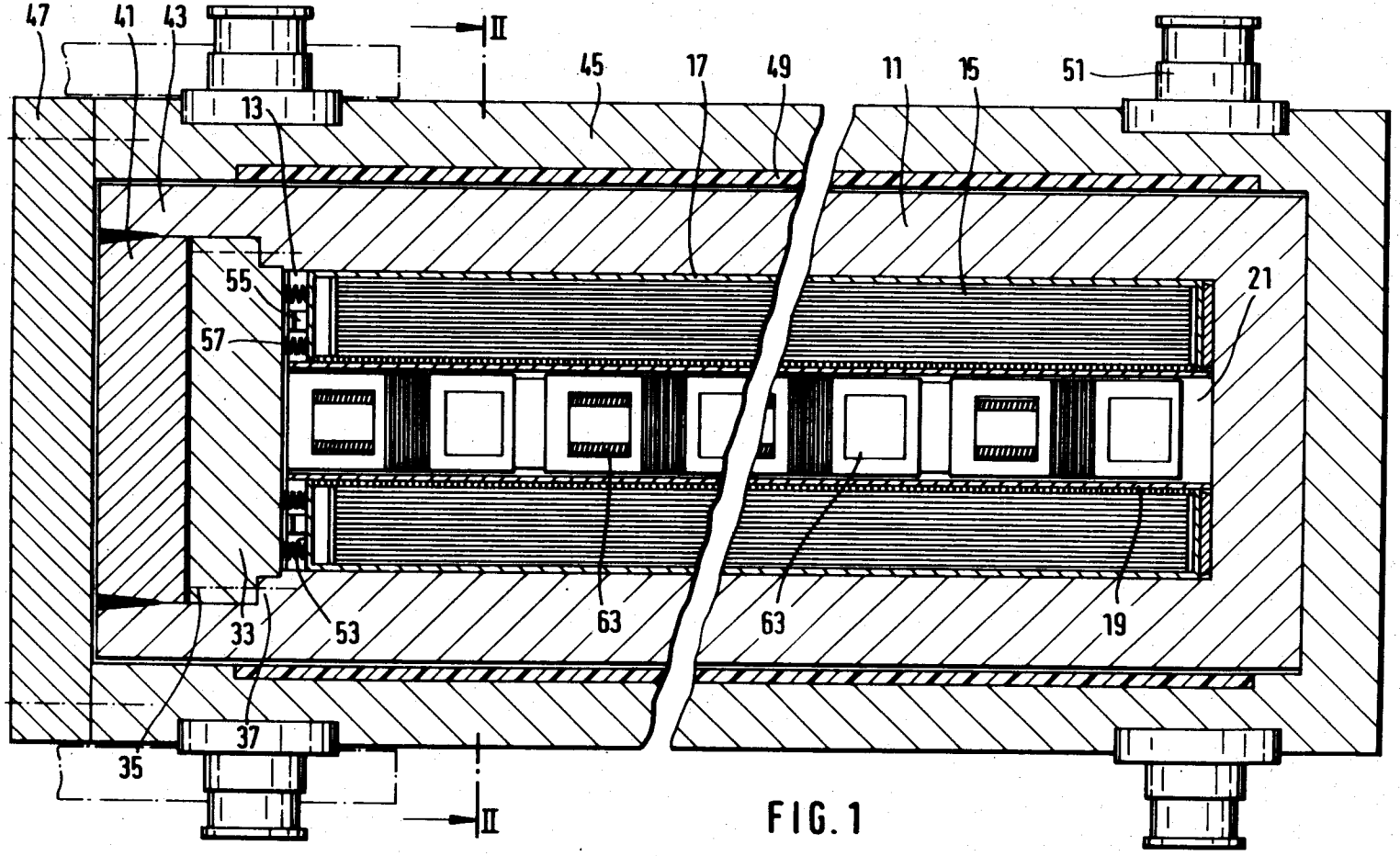
FIG. 1 is a longitudinal section view of a terminal storage container arranged in a shielded transport container.

A terminal storage container 11 of steel (FIGS. 1 and 2) includes a circular storage space 13 to accommodate the individual fuel rods 15 of several irradiated nuclear reactor fuel elements. The fuel rods 15 are tightly packed in four circular-segmental fuel-rod cans 17. These cans 17 are closed after being loaded. The fuel-rod cans 17 are placed in a cage 19 which is inserted into the circular storage space 13. When viewed in cross-section, this insert cage 19 includes a centrally located square shaft 21 from the corners of which diagonal partition walls 23 extend to the container inner wall 24 of the storage space 13. This results in the provision of four storage compartments 25 for receiving the fuel-rod cans 17.

The fuel-rod cans 17 are of circular-segmental configuration. The rear walls 27 of cans 17 abutting the container inner wall 24 are curved and have a curvature corresponding to the curvature of the container inner wall 24. The radially extending sides 29 of the cans 17 are parallel to the partition walls 23. The inwardly facing wall 31 of each fuel-rod can is of a lattice configuration and extends parallel to a corresponding one of the sides of the square central shaft 21.

A chamfer forms the transition between the radial sides 29 of the fuel-rod cans 17 and their curved rear wall 27.

Each fuel-rod can 17 is capable of holding the fuel rods of two disassembled irradiated nuclear reactor fuel elements. Loading takes place with the can 17 lying on its rear wall 27. The latticed wall 31 is not yet set in place at this stage. The fuel rods are loaded into the can 17 through the opening. Following loading, the wall 31 is welded to the can.

The loading opening of the terminal storage container 11 is closed by a stepped cap 33 (FIG. 1) which is fastened onto a suitable step 37 of the loading opening by means of threaded bolts 35. A seal (not shown) is placed between cap 33 and container 11. Another cap 41 is arranged on top of the screw-on cap 33 which is inserted into the loading opening and welded to the container wall 43.

Figure 2:
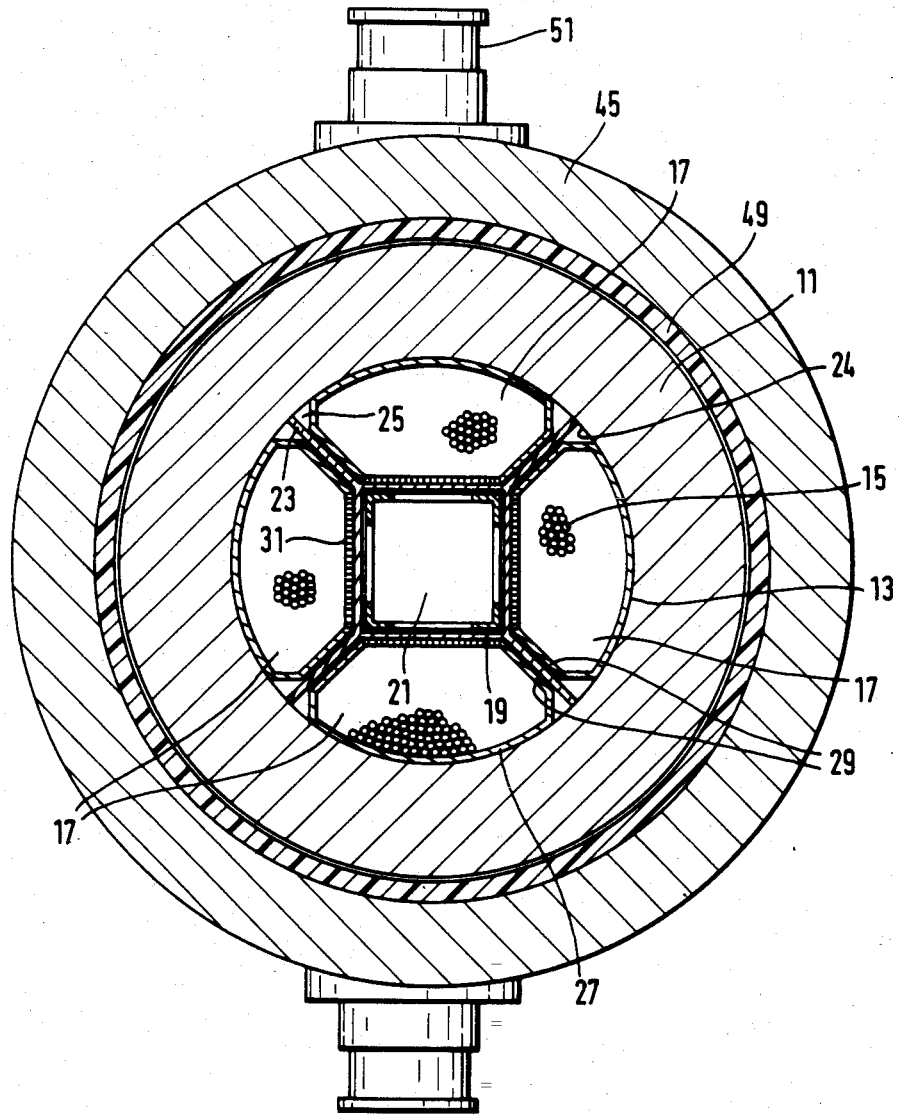
FIG. 2 is a cross-section taken along the line II—II of FIG. 1.

In the assembly shown in FIGS. 1 and 2, the terminal storage container 11 is placed into a shielded transport container 45. The loading opening of the shielded transport container 45 is closed by a closure cover 47 which is secured by threaded fasteners. A polyethylene layer 49 is inserted into the inner wall of the shielded transport container 45 for shielding neutrons. The shielded transport container 45 is equipped with carrying lugs 51 secured to its outer periphery.

The loaded fuel-rod cans 17 are each equipped with a handling block 55 on the upper end faces thereof for the application of suitable lifting gear. Hold-down springs 57 bear with one end against the upper end surfaces 53 of the fuel-rod cans 17 and bear with the other end against the cover 33.

The mode of operation of the arrangements described above will now be explained.

The individual fuel rods 15 are loaded into the segmental fuel-rod cans 17 which are then closed. The fuel-rod cans 17 are then seized by the handling block 55 and placed into corresponding ones of compartments 25 of the insert cage 19. Hold-down springs 57 are placed on the upper end faces 53 of the fuel-rod cans 17. As the first cap 33 is fastened to the container 11, the springs will bear against the fuel-rod cans 17 thereby causing the fuel-rod cans 17 to be in constant abutment with the container bottom. The fuel-rod cans 17 lie against the container inner wall 24 with their curved rear walls 27 and a good heat transfer to the container body is thereby ensured.

The empty square center shaft-like compartment 21 in the middle of the storage container 11 is loaded with fuel element structural parts 63 which were separated at the time of disassembly of the fuel elements. These parts include top and bottom pieces as well as the spacers including the control rod guide tubes. The fuel element structural parts are compacted.

Figure 3:
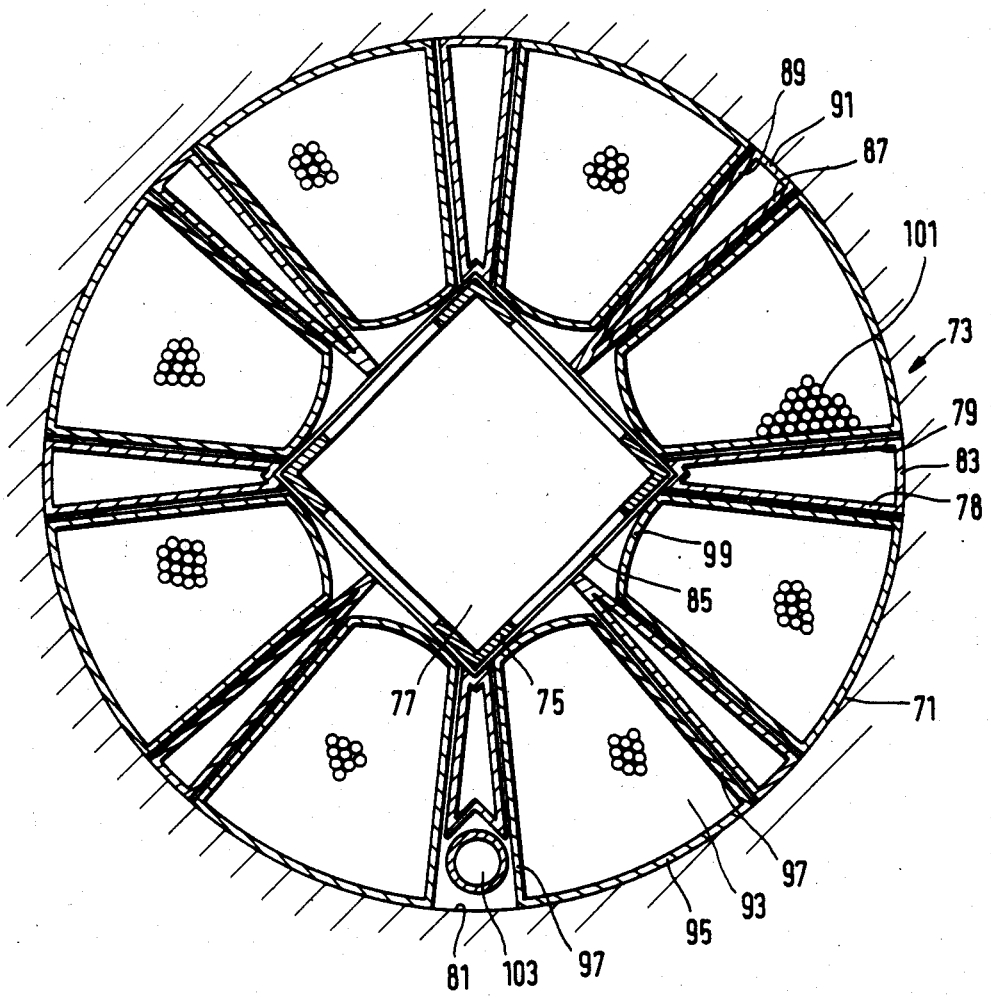
FIG. 3 is a view of a second embodiment of a round insert cage including circular-segmental fuel-rod cans.

FIG. 3 shows the cross-section of a circular storage chamber 71 of a terminal storage container 73 in a modified embodiment. Inserted into the storage chamber 71 is a modified cage 75 which likewise has a square center shaft-like compartment 77 in the middle of the storage chamber 71. This square central shaft-like compartment 77 is held in position by pairs of partition walls (78, 79) which extend from the compartment corners and bear radially against the container inner wall 81. The partition walls (78, 79) of each pair are interconnected by a curved rear wall 83. Further pairs of partition walls (87, 89) extend from the center of the sides 85 of the square central compartment 77 to the container inner wall 81. The ends of the walls (87, 89) of each partition wall pair are connected by a short rear wall 91. The rear walls 83 and 91 of the partition wall pairs (78, 79) and (87, 89), respectively, are curved as shown and face the container inner wall 81.

A circular-segmental fuel-rod can 93 is arranged between a pair of partition walls (78, 79) which extend from a corner of cage 75 and a pair of partition walls (87, 89) which extend from the center of a side 85 thereof. These fuel-rod cans 93 each have curved rear wall 95. The radial sides 97 of the fuel-rod cans 93 extend parallel to the adjacent pairs of partition walls (78, 79) and (87, 89). The inwardly facing wall 99 of the fuel-rod cans 93 is slightly curved.

The embodiment of FIG. 3 shows eight fuel-rod cans 93 arranged in a circle. Each can 93 is capable of accommodating the fuel rods 101 of a single fuel element. The fuel-rod cans of this embodiment are loaded at the end face thereof. The cross-sections of the fuel-rod cans 93 are preferably identical in order not to complicate the front-loading procedure of the cans 93 and to be able to carry out the procedure without modification. Following loading, the upper end wall is welded to its fuel-rod can 93.

For wet loading the fuel-rod cans 93, that is, for loading the same under water, a suction pipe 103 is provided in the circular storage space 81 so that the water can be removed from the container 73 following loading.

Figure 5:
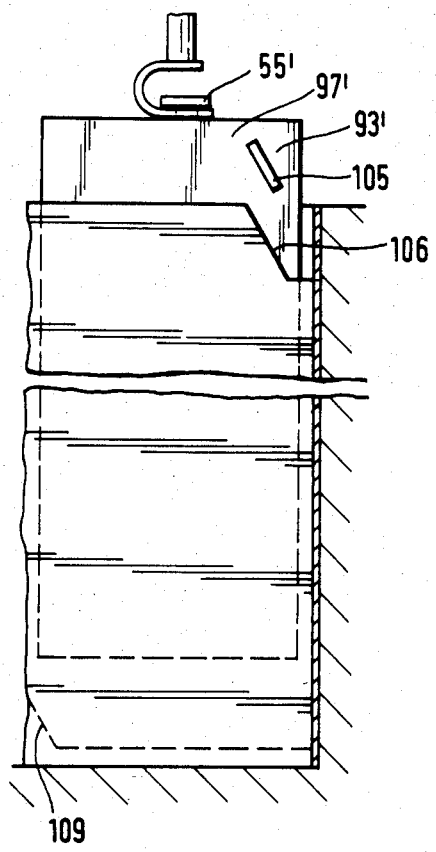
FIG. 5 is a section view of the embodiment of FIG. 4, taken along the line V—V thereof; and, FIG. 6 is a view of the fuel-rod can of FIG. 5 in its fully inserted position in the cage.
Figure 4:
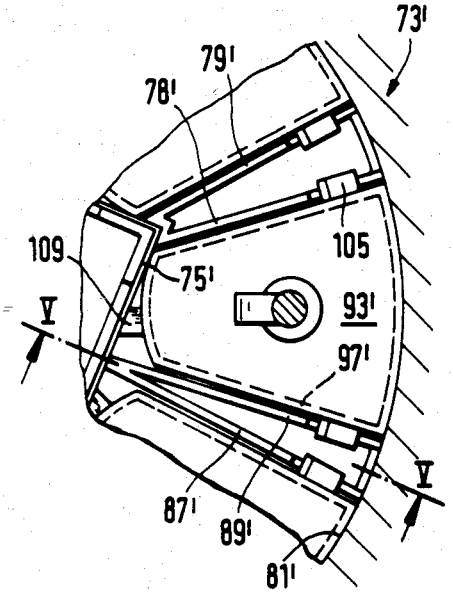
FIG. 4 is a partial top plan view of another embodiment, showing the arrangement of a fuel-rod can in its receiving shaft of an insert cage.
Figure 6:
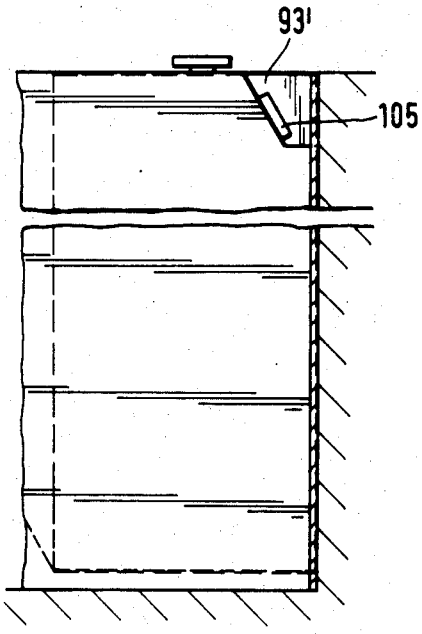

FIGS. 4 to 6 illustrate another embodiment of the insert cage and the fuel-rod cans of FIG. 3. Like parts are assigned like reference numerals, with a prime being added.

Inclined guides 105 are provided in the upper region on the radial sides 79' of each fuel-rod can 93'. These upper guides 105 cooperate with inclined engagement surfaces 106 provided in the adjacent partition walls of partition pairs (78', 79') and (87', 89'), respectively, of the insert cage 75'. At the lower end of the insert cage 75', outwardly extending inclined guide surfaces 109 are provided in the vicinity of the bottom of the storage container 73'. The guideways 105 and the guide surfaces 109 urge the fuel-rod cans 93' against the container inner wall 81' as they are being inserted.

It is understood that the foregoing description is that of the preferred embodiments of the invention and that various changes and modifications may be made thereto without departing from the spirit and scope of the invention as defined in the appended claims.

What is claimed is:

1. A nuclear waste storage container assembly for storing radioactively-contaminated structural pieces and fuel rods of disassembled irradiated nuclear reactor fuel elements, the fuel rods giving off decay heat and the structural pieces giving off a decay heat less than the fuel rods, the storage container assembly comprising:

a vessel defining a longitudinal axis and having a base wall and a cylindrical side wall extending upwardly from said base wall to conjointly define a storage space of circular cross section extending in the direction of said axis, said vessel further having an opening at one longitudinal end thereof communicating with said storage space;

a plurality of elongated cans for storing said fuel rods therein, each of said cans having a circular-segmented cross section with one curved wall defining a curved wall surface having a radius of curvature corresponding to the radius of curvature of said cylindrical side wall;

holding means for holding said plurality of cans and including structure defining a shaft-like enclosure extending in the direction of said axis for storing said structural pieces;

said holding means being adapted for insertion into said storage space so as to cause said cans to be disposed radially of and in surrounding relationship to said axis;

said holding means being configured to hold said cans in a circle-like arrangement one adjacent the other with the respective curved wall surfaces of all of said cans being in flush direct contact engagement with the cylindrical inner wall surface of said side wall so as to permit the direct transfer of said decay heat from all of said cans through said curved wall surfaces thereof directly to said vessel;

each of said cans having respective mutually adjacent radial walls extending from said curved wall thereof which are limited in radial direction so as to permit said cans to be accommodated in said holding means in surrounding relationship to said enclosure;

cover means for closing off said opening of said vessel; and, hold-down resilient means for holding said cans in position within said storage space and against the inner wall surface of said base wall so as to permit the transfer of further amounts of said decay heat from all of said cans directly to said vessel.

2. The storage container assembly of claim 1, each of said cans having end faces at respective longitudinal ends thereof, said shaft-like enclosure being configured to have a square cross-section in a plane perpendicular to said axis; said hold-down resilient means being a plurality of spring means disposed between said cover and corresponding ones of one of the end faces of said cans.

3. The storage container assembly of claim 2, said holding means comprising a plurality of partition units extending between said enclosure and said inner wall surface of said vessel, each two mutually adjacent ones of said partition units conjointly defining a shaft-like compartment therebetween for receiving one of said cans therein.

4. The storage container assembly of claim 3, each of said partition units including two interconnected partition walls extending between said enclosure and said inner wall surface.

5. The storage container assembly of claim 3, said mutually adjacent radial walls of each of said elongated cans facing toward corresponding ones of said partition units when disposed in one of said shaft-like compartments; said storage container assembly further comprising guide means formed at the interface of each of said cans and the corresponding one of said shaft-like compartments for guiding said can into said shaft-like compartment.

6. The storage container assembly of claim 5, said guide means including inclined guide fins formed on said mutually adjacent sides of said cans and corresponding projections formed on said partition units for receiving said guide fins as the can is placed in the shaft-like compartment corresponding thereto.

7. The storage container assembly of claim 6, said guide means further including inclined surface means formed on said holding means for thrusting said cans outwardly and away from said axis into contact engagement with said inner surface wall of said vessel as said cans are placed into said corresponding ones of said compartments.

8. A nuclear waste storage container assembly for storing radioactively-contaminated structural pieces and fuel rods of disassembled irradiated nuclear reactor fuel elements, the fuel rods giving off decay heat and the structural pieces giving off a decay heat less than the fuel rods, the storage container assembly comprising:

a vessel defining a longitudinal axis and having a base wall and a cylindrical side wall extending upwardly from said base wall to conjointly define a storage space of circular cross section extending in the direction of said axis, said vessel further having an opening at one longitudinal end thereof communicating with said storage space;

a plurality of elongated cans for storing said fuel rods therein, each of said cans having a circular-segmented cross section with one curved wall defining a curved wall surface having a radius of curvature corresponding to the radius of curvature of said cylindrical side wall;

holding means for holding said plurality of cans and including structure defining a shaft-like enclosure extending in the direction of said axis for storing said structural pieces;

said holding means being adapted for insertion into said storage space so as to cause said cans to be disposed radially of and in surrounding relationship to said axis;

said holding means being configured to hold said cans in a circle-like arrangement one adjacent the other with the respective curved wall surfaces of all of said cans being in flush direct contact engagement with the cylindrical inner wall surface of said side wall so as to permit the direct transfer of said decay heat from all of said cans through said curved wall surfaces thereof directly to said vessel; and, each of said cans having respective mutually adjacent radial walls extending from said curved wall thereof which are limited in radial direction so as to cause said cans to conjointly define an elongated compartment within said vessel along said axis for storing said structural pieces therein.

* * * * *